US009835372B2

(12) United States Patent
Haltmeyer et al.

(10) Patent No.: US 9,835,372 B2
(45) **Date of Patent: *Dec. 5, 2017**

(54) UNDER MOUNT ROLLER FOR CRISPER SYSTEM

(71) Applicant: Whirlpool Corporation, Benton Harbor, MI (US)

(72) Inventors: Ronald E. Haltmeyer, Swisher, IA (US); Anant Ravindra Karanjikar, Pune (IN); Bill J. Koons, Williamsburg, IA (US); Dean A. Martin, Solon, IA (US); Julia B. Burke, Chicago, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/149,846

(22) Filed: May 9, 2016

(65) Prior Publication Data

US 2016/0252295 A1 Sep. 1, 2016

Related U.S. Application Data

(63) Continuation of application No. 14/678,261, filed on Apr. 3, 2015, now Pat. No. 9,360,246, which is a (Continued)

(51) Int. Cl.
*F25D 23/00* (2006.01)
*F25D 25/02* (2006.01)
(Continued)

(52) U.S. Cl.
CPC ..... *F25D 25/025* (2013.01); *E05B 65/0042* (2013.01); *F25D 11/00* (2013.01);
(Continued)

(58) Field of Classification Search
CPC ..... F25D 25/025; F25D 23/028; F25D 23/04; A47B 88/04; A47B 88/0444; A47B 88/0451; A47B 88/46; A47B 88/0466
(Continued)

(56) References Cited

U.S. PATENT DOCUMENTS 1,948,118 A 2/1934 Klemme
1,975,327 A 10/1934 Loney
(Continued)

FOREIGN PATENT DOCUMENTS

CN 2881472 3/2007
DE 1175837 B 8/1964
(Continued)

OTHER PUBLICATIONS

Partial European Search Report, dated Jul. 16, 2015, 7 pages.

*Primary Examiner* — Janet M Wilkens
(74) *Attorney, Agent, or Firm* — Nyemaster Goode, P.C.

(57) ABSTRACT

A refrigerator is provided that includes a crisper system having one or more moveable and removable drawers. The drawers include rollers extending downwardly and outwardly from the drawers to provide maximum storage volume. The rollers are configured to work with channels formed in a support system, which may be integrally formed with a bottom floor of a compartment of the refrigerator. Therefore, the rollers and channels of the support system provide easy access and removability of the drawers of the crisper system.

20 Claims, 9 Drawing Sheets

Related U.S. Application Data continuation of application No. 13/832,471, filed on Mar. 15, 2013, now Pat. No. 9,039,110.

(51) Int. Cl.

| | |
|---|---|
| ***F25D 23/04*** | (2006.01) |
| ***F25D 23/12*** | (2006.01) |
| ***E05B 65/00*** | (2006.01) |
| ***F25D 11/00*** | (2006.01) |
| ***F25D 23/02*** | (2006.01) |

(52) U.S. Cl.

CPC ..... *F25D 23/028* (2013.01); *F25D 23/04* (2013.01); *F25D 23/12* (2013.01); *F25D 2400/38* (2013.01)

(58) Field of Classification Search

USPC ..... 312/330.1, 333, 334.27, 334.33, 334.39, 312/334.41, 334.42, 334.43, 3, 34.14, 312/334.15, 334.18, 334.19, 334.21, 312/334.45; 384/18, 19, 58; 62/382

See application file for complete search history.

(56) References Cited

U.S. PATENT DOCUMENTS

| | | | |
|---|---|---|---|
| 2,755,158 | A | 7/1956 | Davidson |
| 2,764,875 | A | 10/1956 | Beckett et al. |
| 3,301,610 | A | 1/1967 | Packett |
| 4,121,878 | A | 10/1978 | Lokken |
| 4,549,774 | A | 10/1985 | Bessinger et al. |
| 4,834,557 | A | 5/1989 | Dreinhoff |
| 4,979,262 | A | 12/1990 | Lautenschlager |
| 5,090,820 | A | 2/1992 | Lautenschlager |
| 5,470,144 | A | 11/1995 | Wen |
| 8,152,255 | B2 | 4/2012 | Nam |
| 8,226,182 | B2 | 7/2012 | Park et al. |
| 2008/0036346 | A1 | 2/2008 | Kobayashi |
| 2009/0056365 | A1 | 3/2009 | Benz |
| 2009/0309472 | A1 | 12/2009 | Park et al. |
| 2012/0262046 | A1 | 10/2012 | Park et al. |
| 2012/0273504 | A1 | 11/2012 | Rackley et al. |
| 2013/0127323 | A1 | 5/2013 | Seo et al. |
| 2013/0257254 | A1 | 10/2013 | Austin et al. |
| 2013/0278126 | A1 | 10/2013 | Jang et al. |
| 2014/0252938 | A1 | 9/2014 | Kim |
| 2014/0265801 | A1 | 9/2014 | Klitzing et al. |
| 2014/0265808 | A1 | 9/2014 | Kendall |

FOREIGN PATENT DOCUMENTS

| | | | |
|---|---|---|---|
| EP | 1106107 | | 6/2001 |
| JP | 11201625 | | 7/1999 |
| JP | 2000-2480 | | 1/2000 |
| JP | 2000002480 | | 1/2000 |
| JP | 3419988 | | 4/2003 |
| JP | 2005140428 | | 6/2005 |
| JP | 2006078057 | | 3/2006 |
| JP | 2008121976 | | 5/2008 |
| KR | 2003021799 | A | 3/2003 |
| KR | 2003023801 | A | 3/2003 |
| KR | 20030039024 | A | 5/2003 |
| KR | 100430216 | | 4/2004 |
| KR | 1020040064564 | | 7/2004 |
| KR | 2009106233 | A | 10/2009 |
| KR | 2010018234 | A | 2/2010 |
| KR | 20100023474 | | 3/2010 |
| KR | 1020100023474 | | 3/2010 |
| KR | 101028583 | B1 | 9/2010 |
| KR | 100998369 | | 11/2010 |
| KR | 101013683 | | 1/2011 |
| KR | 101013683 | | 2/2011 |

UNDER MOUNT ROLLER FOR CRISPER SYSTEM

CROSS-REFERENCE TO RELATED APPLICATIONS

This application is a Continuation of and claims priority to U.S. patent application Ser. No. 14/678,261, filed on Apr. 3, 2015, entitled "UNDER MOUNT ROLLER FOR CRISPER SYSTEM," pending, which is a Continuation of and claims priority to U.S. patent application Ser. No. 13/832,471, filed on Mar. 15, 2013, entitled "UNDER MOUNT ROLLER FOR CRISPER SYSTEM," issued as U.S. Pat. No. 9,039,110, the disclosures of which are hereby incorporated herein by reference in their entireties.

FIELD OF THE INVENTION

The present invention relates generally to refrigerators. More particularly, but not exclusively, the invention relates to a crisper system for use in a refrigerator compartment including an under mount rolling system.

BACKGROUND OF THE INVENTION

Bottom mount refrigerators include a freezer compartment on the bottom, with the fresh food or refrigerator compartment above the freezer compartment. One or more doors provide access to the fresh food compartment, and a separate door provides access to the freezer compartment. The freezer door or doors may be drawer-type doors that are pulled out, or they may be hingedly connected similar to the refrigerator compartment doors, such that they are rotated to provide access within.

Both the refrigerator and freezer compartments may contain storage drawers or compartments that are used to store items. These drawers may be separately climate controlled from the rest of the compartment in order to store certain types of perishables. For example, many refrigerator compartments include crisper drawers that are configured to store fruits and vegetables. The drawers generally are controlled such that the humidity in the drawers is higher than in the rest of the compartment in order to increase the storage life of the fruits and/or vegetables.

Generally, the crisper drawers are hanged on shelves, side plates, or compartment walls of the refrigerator. A track may be included on the walls or underside of the shelves, with a portion of the drawers fitting into the tracks and movable within the same. The drawers may be completely removable from the tracks by continuing to move the drawers relative to the tracks past the front edge of the track or connecting member.

However, having such a hanging design for the drawers of a compartment is complex. The structure to allow the drawers to move can be complex for both installation and for removal of the drawer. As the drawer is moved within the track, one side may be moved faster than the other, which can cause binding or the like. This will make it more difficult to remove the drawer from the refrigerator, or to open the drawer to provide access to the interior.

Therefore, there is a need in the art for an improved crisper drawer assembly that is less complex, and that is easy to install. There is also a need in the art for a drawer or drawers that can be quickly and easily removed from the compartment of the refrigerator.

SUMMARY OF THE INVENTION

Therefore, it is a primary object, feature, and/or advantage of the present invention to provide an apparatus that overcomes the deficiencies in the art.

It is another object, feature, and/or advantage of the present invention to provide a drawer system for a refrigerator that includes easy to remove and reinstall drawers relative to the system.

It is yet another object, feature, and/or advantage of the present invention to provide a crisper system that includes an under mount roller for the drawers.

It is still another object, feature, and/or advantage of the present invention to provide a roller system for crisper system that includes rollers that have even resistance when travelling out and into the compartment.

It is a further object, feature, and/or advantage of the present invention to provide an integral support system for the crisper that is integral with a wall or floor of the compartment.

It is yet a further object, feature, and/or advantage of the present invention to provide a drawer for a crisper system that has rollers that do not reduce the storage capacity of the drawer.

It is still a further object, feature, and/or advantage of the present invention to provide a crisper system that includes a plurality of drawers that are able to move and be removed from the refrigerator.

These and/or other objects, features, and advantages of the present invention will be apparent to those skilled in the art. The present invention is not to be limited to or by these objects, features and advantages. No single embodiment need provide each and every object, feature, or advantage.

According to an aspect of the present invention, a refrigerator is provided. The refrigerator includes a cabinet, a compartment within the cabinet, at least one door for providing access to the compartment, a support system in the compartment comprising at least two channels extending generally outward therefrom, and a drawer forming a storage area, the drawer comprising a plurality of rollers extending away from the storage area and configured to move between the two channels. The rollers may extend generally out and down from the storage area such that the drawer is moved via the rollers on the underside of the drawer.

According to another aspect of the present invention, a refrigerator is provided. The refrigerator includes a refrigerator compartment comprising a support system formed as part of a bottom wall of said compartment, the support system comprising a plurality of channels. At least one drawer is positioned at the support system and a plurality of rollers are included extending outwardly and downwardly from a portion of the drawer. The rollers of the drawer are configured to be placed in the channels of the support system to aid in the movement of the drawer relative to the refrigerator compartment.

According to yet another aspect of the invention, a crisper system including a support system and drawer for use in a compartment of a refrigerator is provided. The system includes a base, a plurality of channels extending from the base comprising a generally vertical wall and a lip extending generally perpendicular to the wall, and a drawer comprising a storage area and a plurality of wheels extending from the storage area. The wheels are configured to move under the lip and adjacent the wall.

DETAILED DESCRIPTION OF THE PREFERRED EMBODIMENTS

Figure 1:
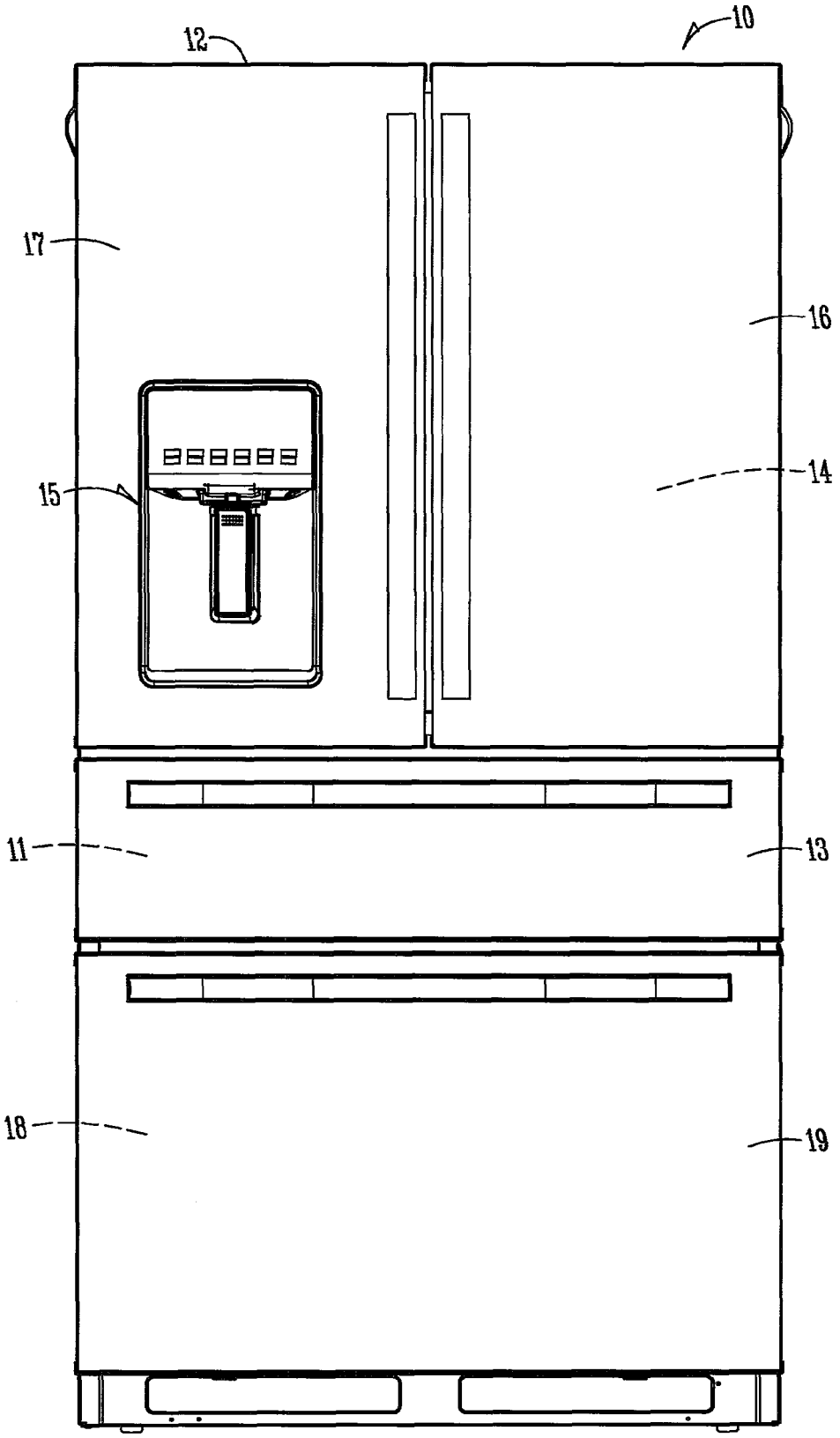
FIG. 1 is a front elevation view of a bottom mount refrigerator.

FIG. 1 is a front elevation view of a bottom mount refrigerator 10. The bottom mount refrigerator 10 includes a cabinet 12 encapsulating the compartments of the refrigerator 10. As shown in FIG. 1, the upper compartment is a refrigerator or fresh food compartment 14. First and second doors 16, 17 provide access to the interior of the refrigerator compartment 14. A dispenser 15 is positioned on one of the doors 16, 17 of the refrigerator compartment 14. The dispenser 15 may be a water dispenser, ice dispenser, other beverage dispenser, or some combination thereof. Furthermore, the dispenser 15 may be placed on any door of the refrigerator 10, or the dispenser 15 may be placed within one of the compartments of the refrigerator 10. For example, the dispenser 15 may be placed at one of the interior walls of the refrigerator compartment 14, thus being part of the cabinet 12. The placement of the dispenser 15 is not to limit the present invention.

Positioned generally below the refrigerator compartment 14 is a pantry compartment 11. The pantry compartment 11 is a compartment having different climates than the refrigerator compartment 14. For example, the pantry 11 may be at a warmer temperature than the refrigerator compartment 14 such that it is used to defrost items or to keep items at a certain humidity. The pantry compartment also includes a door 13, which is shown as a drawer-type door. However, the present invention contemplates that the pantry door 13 may be a drawer, a hinged door, multiple doors or drawers, or some combination thereof.

Positioned below the pantry compartment 11 is a freezer compartment 18. The freezer compartment 18 is generally set to be at or below 0° F., while the refrigerator compartment 14 is set to be at a warmer temperature so as to prevent freezing of the items stored therein. The freezer door 19 provides access to within the freezer compartment 18. The freezer door 19 of FIG. 1 is shown as a drawer-type door. However, the present invention contemplates that the freezer door 19 may be a drawer, a hinged door, multiple doors or drawers, or some combination thereof.

It should also be appreciated that while the figures show a bottom mount style refrigerator 10, the present invention contemplates that any style of a refrigerator may be included as part of the invention. The figures merely depict examples of a type of refrigerator that can be used with the present invention.

Figure 2:
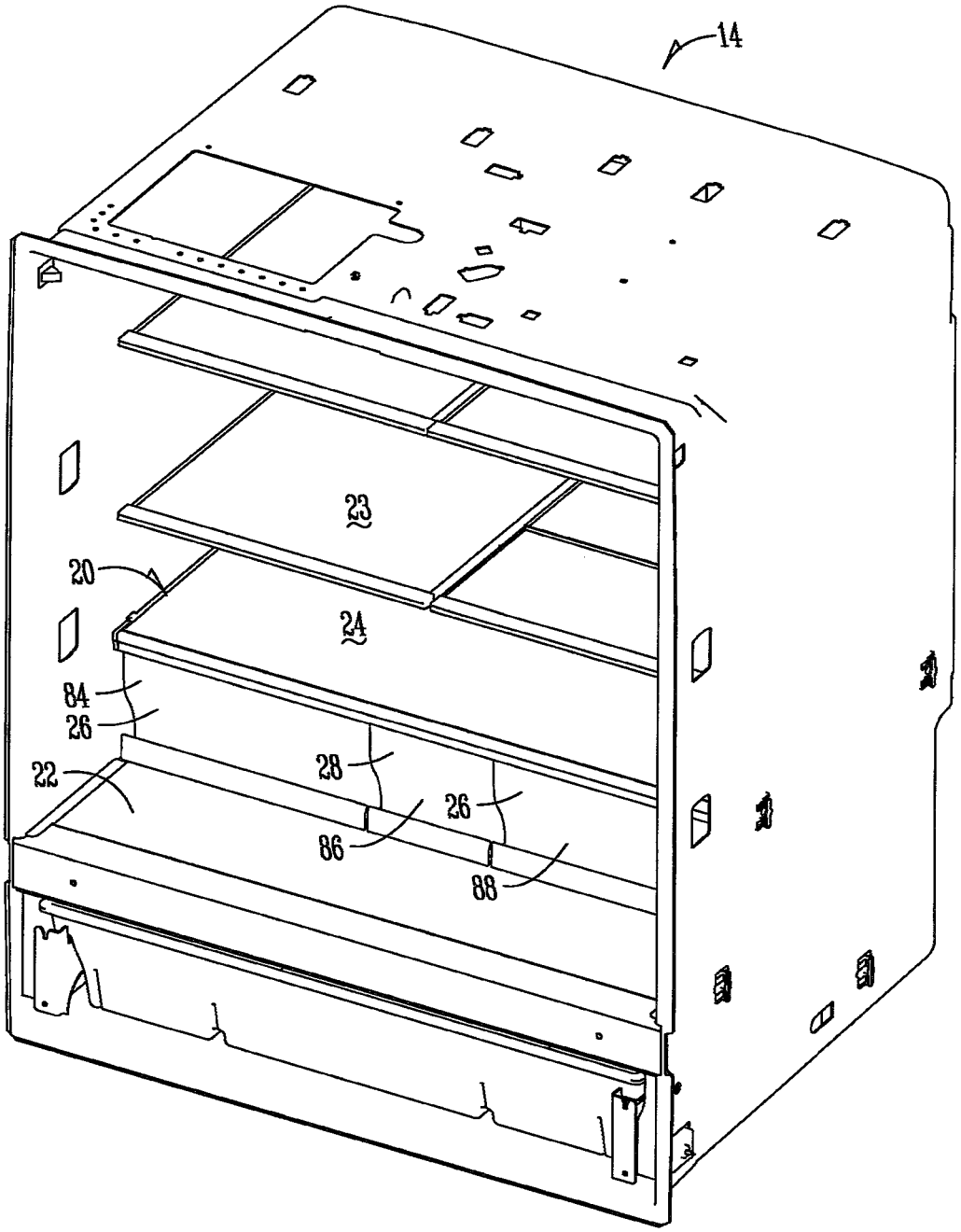
FIG. 2 is a perspective view of the refrigerator compartment with the doors removed to show the interior of the compartment.

FIG. 2 is a perspective view of the refrigerator compartment 14 with the cabinet, the insulation, and the doors removed to show the interior of the compartment 14. The refrigerator compartment 14 of FIG. 2 has been isolated to show the interior of the compartment, including the walls forming the interior. Positioned within the refrigerator compartment 14 is a crisper system 20 including a plurality of drawers that may be considered crisper drawers. Crisper drawers are climate controlled storage areas for storing perishable items. For example, the crisper drawers may include a higher humidity level than the rest of the refrigerator compartment 14 such that it is an ideal climate for storing fruits, vegetables, or other perishable items. While the figures show the use of a first drawer 84, second drawer 86, and third drawer 88 positioned within the refrigerator compartment 14, it should be appreciated that any number of drawers may be utilized with the crisper system 20 of the present invention, and the exact number shown is not to limit the system. For example, only one drawer expanding the full width or a partial width of the refrigerator compartment 14 may be utilized with the crisper system 20 of the present invention.

The interior of the refrigerator compartment 14 also includes a plurality of shelves 23 for organizing and storing items thereon. The crisper system 20 shown near the bottom of the refrigerator compartment 14 includes a cover shelf 24, as will be shown and described in greater detail below. On the underside of the crisper system 20 is a support system 22, which aids in the movements of the drawers of the crisper system 20. In addition, the crisper system 20 shown in FIG. 2 includes both larger drawers (which also may be known as pan crispers) 26, as well as smaller crisper drawers 28. The exact size of the crisper drawers is not to limit the present invention, and it is contemplated that any size of drawer be used with the crisper system 20 of the invention. The notations of large and small drawers are merely used to describe the differences of the drawers shown in the figures.

Figure 3:
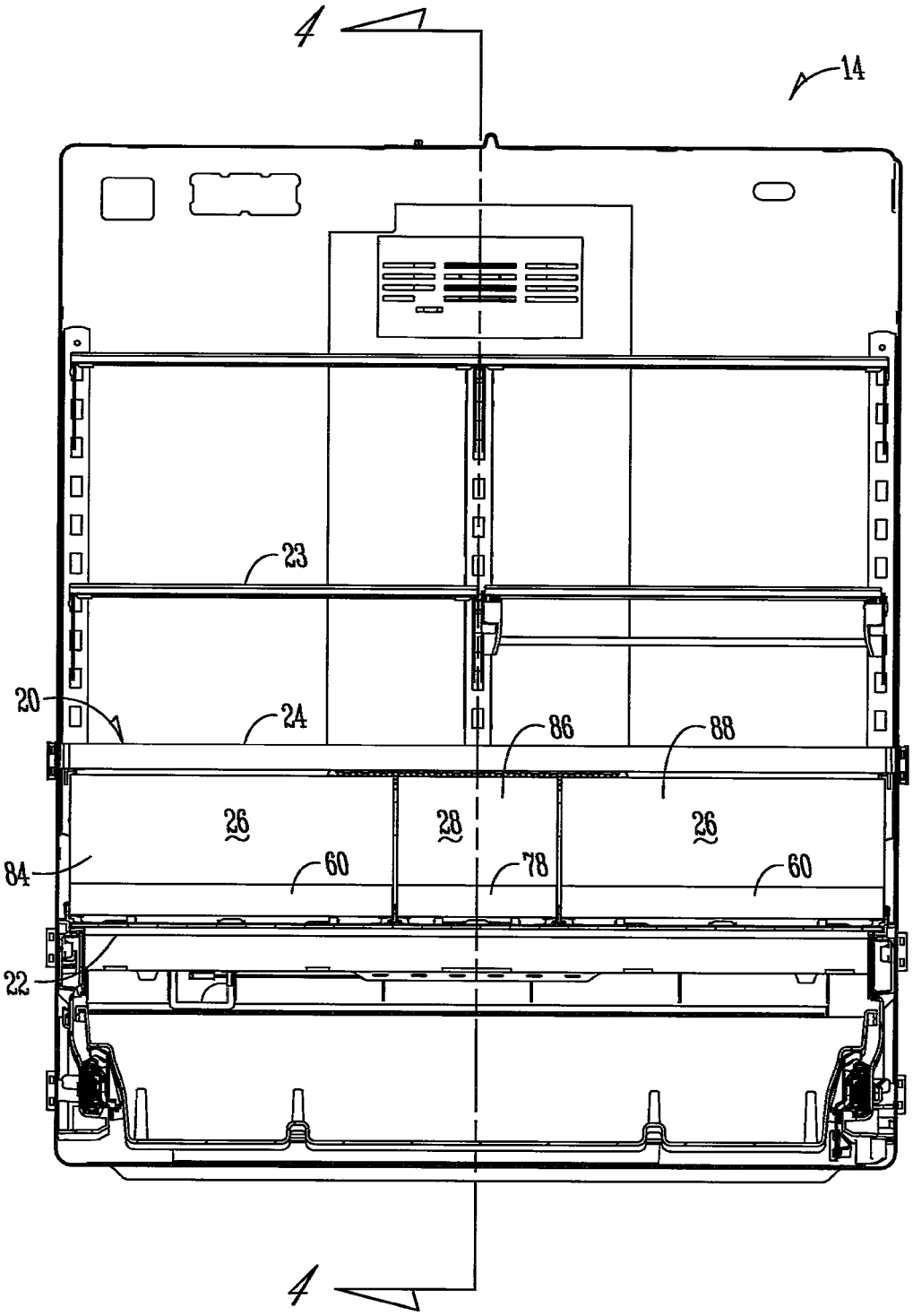
FIG. 3 is front elevation view of the refrigerator compartment of the refrigerator with the doors removed.

FIG. 3 is a front elevation view of the refrigerator compartment 14 of the refrigerator 10 with the drawers removed. FIG. 3, similar to FIG. 2, shows the crisper system 20 of the invention. FIG. 3 also shows a configuration of the shelves 23 of the refrigerator compartment 14. FIG. 3 shows the support system 22 of the crisper system 20. As discussed, the support system 22 is configured to work with the drawers 84, 86, 88 to allow the drawers to be moved from a closed position to an open position. The support system 22 may be formed integrally with the refrigerator compartment 14, such that it forms the bottom wall or floor of the refrigerator compartment 14. Thus, the integrally formed support system 22 may be formed at the time of the refrigerator compartment 14 such that no additional steps need to be taken to install said support system 22. FIG. 3 also shows handles 60, 78 attached to the drawers to aid in the movement of the drawers by a user. The handles add an ease of use such that applying a slight pressure at the handles will cause the drawers to roll about the support system 22 to an open position, providing access to the interior or storage area of the drawers. In addition, continued movement of the drawers relative to the support system 22 will allow removal of the drawers from the crisper system 20, and thus, refrigerator 10. The easy removal of the drawers will allow a user to more easily access the storage area of the drawers.

Figure 4A:
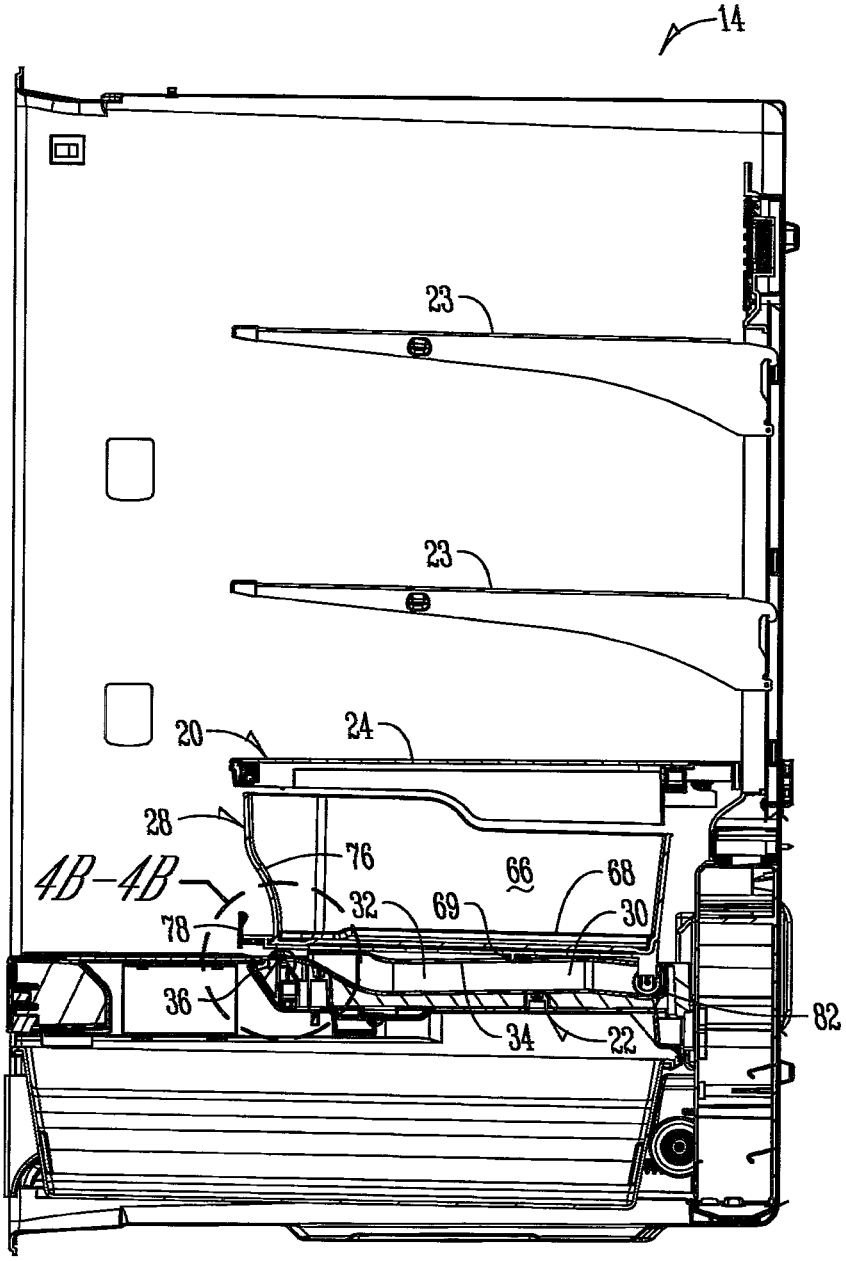
FIG. 4A is a side sectional view of the refrigerator of FIG. 3.

FIG. 4A is a side sectional view of the refrigerator 10 of FIG. 3 taken along line 4-4 of FIG. 3. FIG. 4A shows a more detailed configuration of the crisper system 20, including the support system 22. Shown in FIG. 4A is a sectional view of the smaller drawer 28 having a storage area 66 defined by upstanding walls extending from a bottom 68. A handle 78 is attached to the drawer to aid in movement of the drawer relative to the support system 22.

As discussed, the support system 22 may be integrally formed with the bottom floor of the refrigerator compartment 14. As shown in FIG. 4A, the support system includes a plurality of channels 30 extending generally upward from the support system 22. The channels 30 include a channel wall 32 extending generally vertically from a top surface of the support system 22, as well as a channel lip 34 extending from the top end of the channel wall 32. The channel wall 32 extends generally upward from the channel 30 and the lip 34 extends generally perpendicular to the channel wall 32. Thus, the channels 30 may be a T-shape or half a T-shape when viewing a sectional view from the front. Rollers 82 extending from the drawer 28 are configured to be positioned within the channels 30 to allow the rollers 82 of the drawer 28 to move within the channel 30. As the drawer will include rollers 82 on both sides of the drawer, the rollers will aid in providing an equal removal of the rollers of the drawer such that the drawer will not bind or become friction fit against one or more of the channels.

Furthermore, the support system 22 may include a plurality of fixed rollers 36 at least partially positioned within the support system 22. The fixed rollers 36 are fixed in that they are able to rotate, but they are not connected to the drawers. It is contemplated that the fixed rollers 36 be mounted on one or more axles, with the axles being moveable in a vertical manner to slightly move into the support system 22 to move out of the way of a removed drawer. The fixed rollers 36 aid in the movement of the drawer such that they reduce the friction of the movement of the drawers to allow for less force to be required to open and close the drawers, as well as removing the drawers from the refrigerator 10. The number of fixed rollers may be varied, may include bearings or other friction reducing mechanisms, and also may be evenly spread out along the length or width of the support system 22 to aid in the movement of all of the drawers of the crisper system 20.

The support system 22 may also include a lock 38 comprising an indent 40 and a lip 42 formed therein. The lock 38 is best seen in the enlarged portion of FIG. 4A shown in FIG. 4B. The lock 38 can be configured to selectively block the removal of the drawer from the crisper system 20 by temporarily blocking a stopper 69 that extends generally downwardly from the bottom of a drawer or crisper tray. As mentioned previously, the drawer is removable from the crisper system 20. However, the lock 38 provides some resistance such that the drawer is only removed when the user so desires. Thus, the indent 40 and lip 42 of the lock 38 make it such that the lock will block the removal of the drawer during normal opening of the drawer by blocking the stopper 69 of the drawer. However, the blocking caused by the indent 50 and lip 42 may be overcome by slightly lifting the drawer to allow the stopper 69 to move beyond the lock 38 to remove the drawer from the crisper system 20.

Figure 4B:
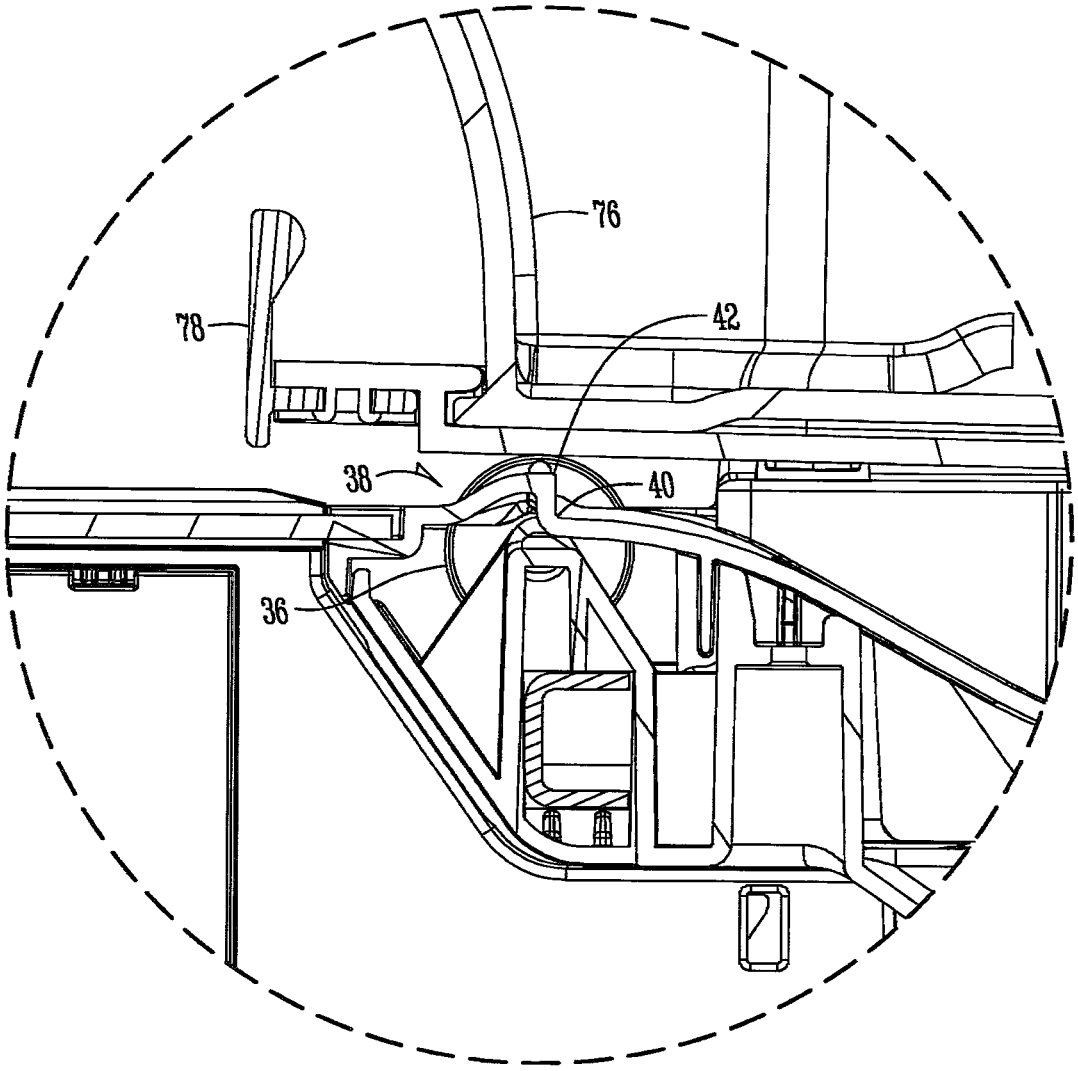
FIG. 4B is an enlarged view of a portion of the view from FIG. 4A.

The operation of the crisper system 20 is as follows. The rollers 82 of the drawer 28, as shown in FIG. 4A, are positioned within channels 30 on opposite sides of the drawer 28 that are spaced approximately equal to the spacing of the rollers 82 on the opposite sides of the drawer 28. The channels 30 allow the rollers 82 to move therein, while aiding the movement by ensuring that one side of the drawer 28 does not move faster than the other side. In the closed position shown in FIG. 4A, a user may grasp the handle 78 of the drawer 28 to provide force to pull the drawer 28 towards the front of the refrigerator compartment 14. The rollers provide movement of the drawer 28 in the channels 30 along with the fixed rollers 36 of the support system 22. The drawer 28 will be moveable until the stopper 69 reaches the lock 38 in the support system 22, as is shown in FIG. 4B. At this point, the lock 38 will at least temporarily stop the movement of the drawer 28 relative to the crisper system 20. If the user desires to fully remove the drawer 28 from the refrigerator 10, an additional force, such as a lifting force, may be applied to overcome the indent 40 and lip 42 of the lock 38 to move the stopper 69 beyond the lock 38 to remove the drawer 28 from the refrigerator 10. To replace the drawer 28, the rollers 82 on opposite sides of the drawer 28 are aligned with the channels 30 and the drawer is simply pushed through the channels 30 to the closed position shown in FIG. 4A.

Figure 5:
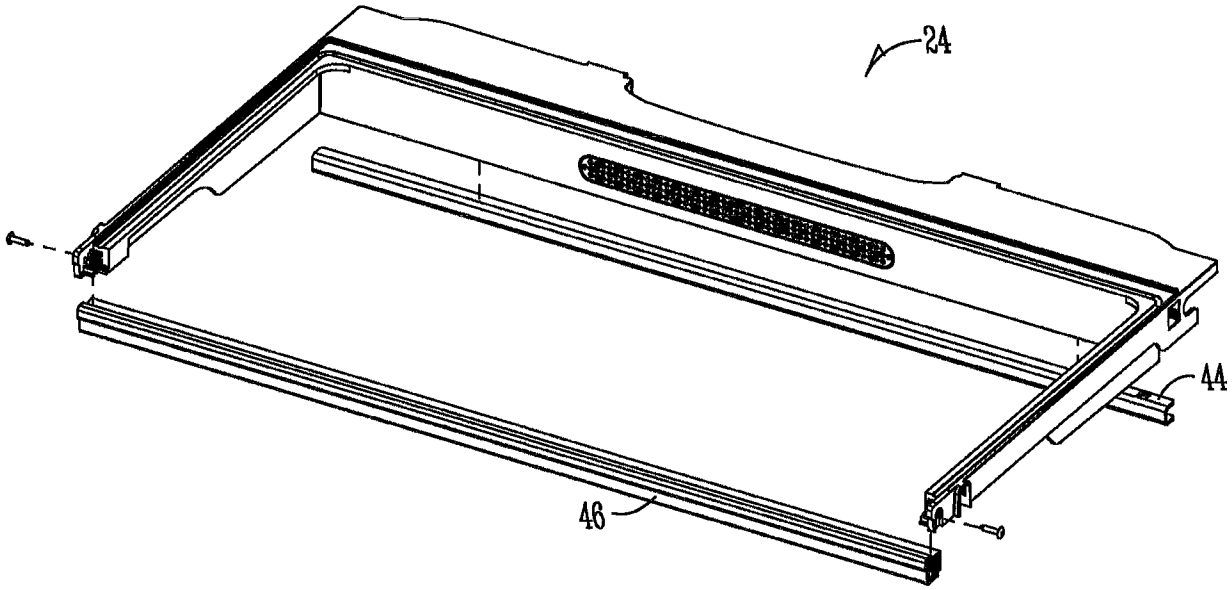
FIG. 5 is a perspective view of the cover for the crisper system according to an embodiment of the invention.

FIG. 5 is a perspective view of the cover shelf 24 for the crisper system 20 according to an embodiment of the invention. The cover shelf 24 may be similarly manufactured to the other shelves 23 as shown in the figures. Thus, the shelf may be used to store and organize items thereon. In addition, the shelf 24 will include a rear support 44 and a front support 46. The front and rear supports are configured to work with the drawers of the crisper system 20.

Figure 6:
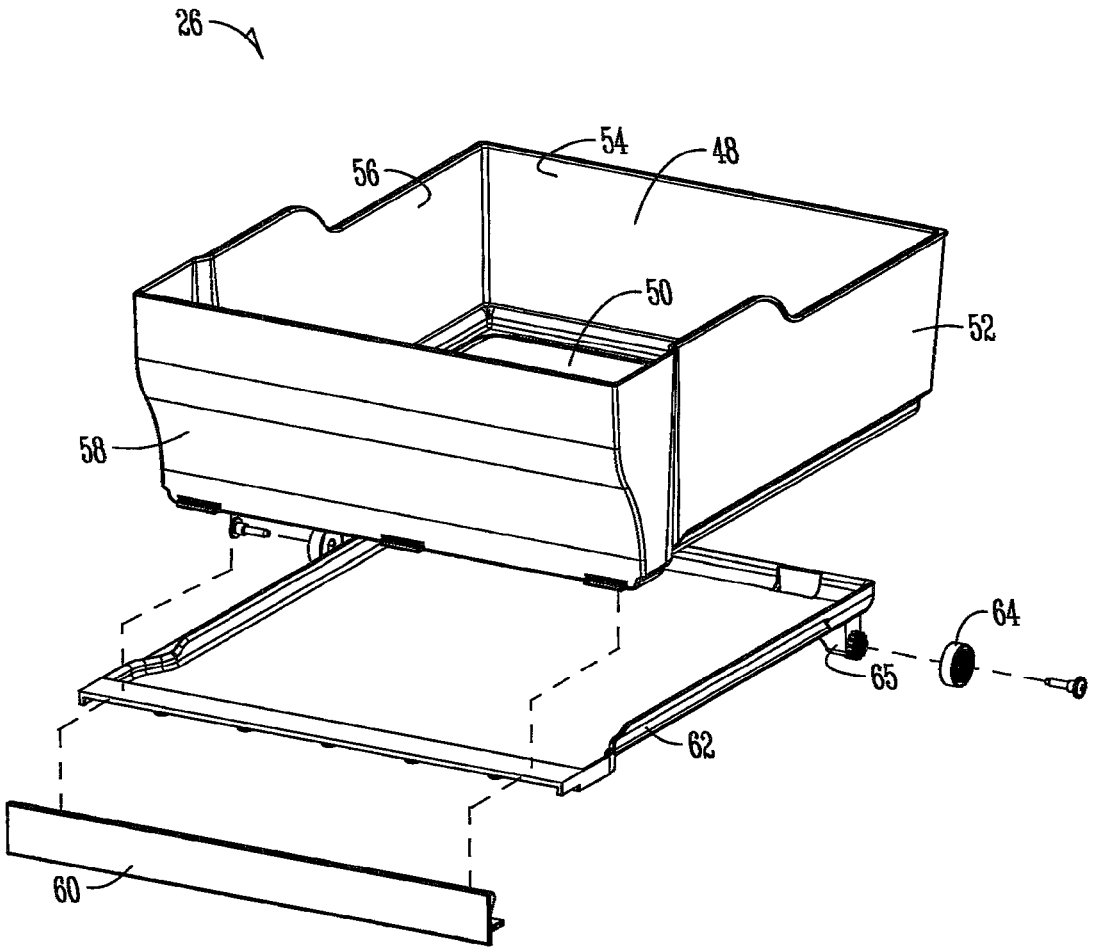
FIG. 6 is an exploded view of a large drawer for use with the crisper system.

FIG. 6 is an exploded view of a large drawer/pan crisper 26 for use with a crisper system 20 of the refrigerator 10. As noted, the mention of large and small drawers are not limiting to the invention and are simply used to distinguish the drawer shown in FIG. 6 and the drawer shown in FIG. 7. The drawer 26 of FIG. 6 includes a storage area 48 defined by a bottom 50, first wall 52, second wall 54, third wall 56, and front wall 58. The walls extend generally upward from the bottom 50 and can be configured to be as high as desired for the refrigerator 10 that the crisper system 20 is used in. The walls and bottom of the drawer or pan crisper 26 may comprise a general purpose polystyrene (GPPS) plastic that can be one step molded or can be individually molded and attached to one another to form the storage area 50. As shown in the embodiment of FIG. 6, a crisper tray 62 may be attached to the bottom of the drawer 26. The crisper tray 62, while not used in all embodiments, can be used to hide the support system under the drawer 26. The crisper tray 62 may include a stopper, such as that shown in FIG. 4A as well. The crisper tray 62 can be snap fit to the drawer to easily attach one to the other. In addition, the crisper tray 62 may comprise a high impact polystyrene (HIPS) material. The handle 60 can be attached to either the front wall 58 of the drawer 56 or the crisper tray 62. If attached to the crisper tray 62, the handle 60 can be attached to the tray 62 by heat staking posts of the crisper tray 62 through the handle 60.

Also extending from either the bottom 50 of the drawer 26 or the bottom side of the crisper tray 62 is a roller mount 65 on either side of the tray or drawer 26. The roller mount 65 extends generally downwardly and outwardly from the tray or drawer and includes an axle for attaching a roller 64 thereto. Roller bearings may also be included the roller mount 65 for the roller 64 to allow easier movement of the roller 64. The roller 64 is attached to the roller mount 65. The roller 64 comprises a two shot molded roller and can include a thermoplastic elastomer (TPE) treading thereon to provide for better traction within the channels 30 of the support system 22. It should be appreciated that the location of the roller mount 65 being downward and outward from the crisper tray 62 or drawer 26 is beneficial for multiple reasons. For example, as the roller mount 65 is not formed in one of the walls of the drawer 56, the storage area 48 of the drawer 26 is allowed to be at a maximum volume. In other words, the roller mount 65 and/or roller 64 do not require an indent into the storage area such that the volume of the storage area is decreased. This allows the drawers to be as large as possible. The design of the rollers also has even resistance from traveling into and out of the channels 30 of the support system 22, which provides a consistent evenness for the user.

Figure 7:
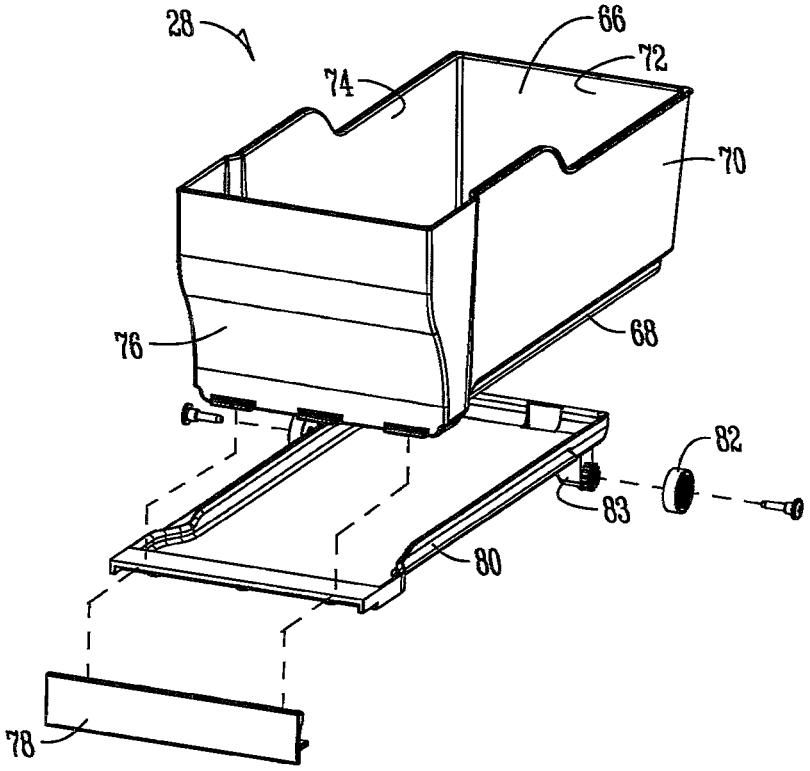
FIG. 7 is an exploded view of a smaller drawer for use with the crisper system.

FIG. 7 is an exploded view of a smaller drawer 28 for use with a crisper system 20 of the present invention. Similar to the drawer shown in FIG. 6, the drawer 28 of FIG. 7 includes a storage area 66 defined by a bottom 68, first wall 70, second wall 72, third wall 74, and a front wall 76. The walls generally extend upward from the bottom 68 to form the storage area 66. Similarly, the walls of the drawer 28 may comprise a GPPS material. Also shown in FIG. 7 is a smaller crisper tray 80 configured to be snap fit to the drawer 28, which can be used to aid in hiding at least a portion of the support system 22. The crisper tray 80 includes the stopper 69 extending generally downward from the tray 80. The crisper tray 80 of FIG. 7 can comprise a HIPS material as well. The handle 78 shown in FIG. 7 may be attached to either the crisper tray 80 or the front 76 of the drawer 28. In addition, similar to the crisper tray 62 of FIG. 6, the crisper tray 80 of FIG. 7 includes roller mounts 83 extending generally downwardly and outwardly from a portion of the crisper tray 80. The roller mounts 83 are configured to attach to the rollers 82 on both sides of the crisper tray 80. The rollers 82 may also be two shot molded rollers and can include a TPE tread thereon. The roller mount 83 of the crisper tray 80 are also shown to extend generally downward and outwardly from the crisper tray 80 to allow for the maximum volume of the drawer 28.

Figure 8:
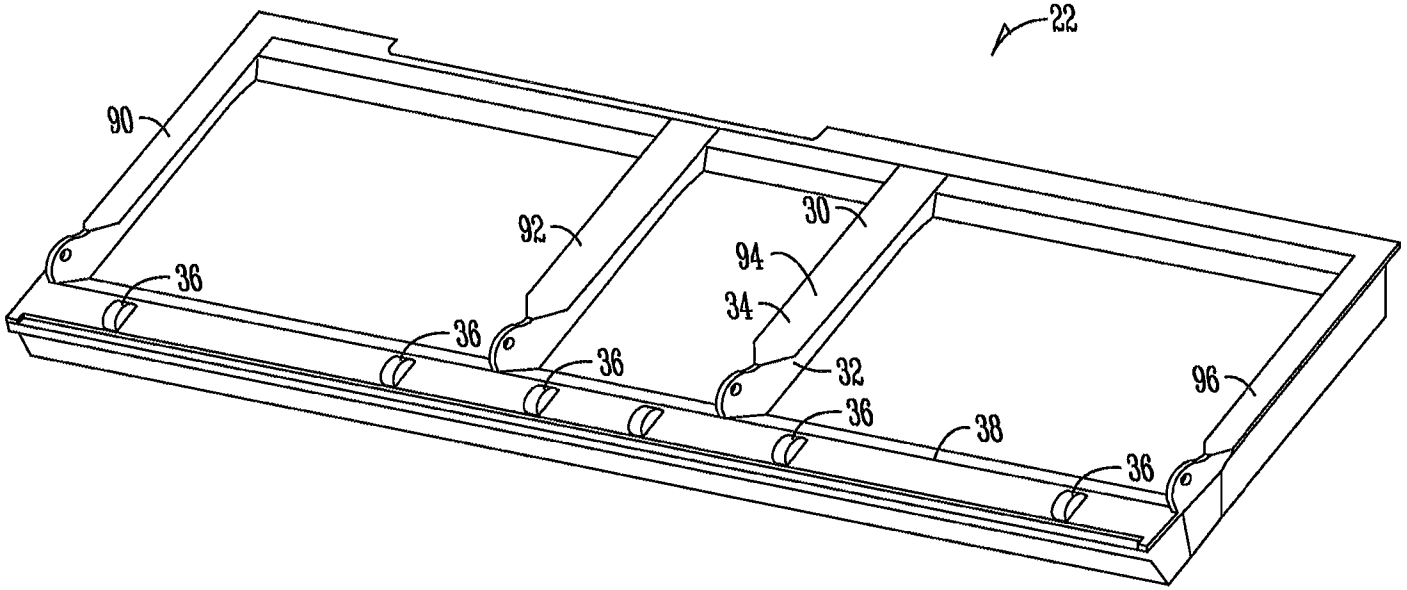
FIG. 8 is a perspective view of the floor of the refrigerator compartment and support system for the crisper system.

FIG. 8 is a perspective view of the floor of the refrigerator compartment 14 including the support system 22 for the crisper system 20. As discussed, the support system 22 may be formed integrally with the refrigerator compartment 14 to form the bottom floor of the compartment. A plurality of channels 30 including a channel wall 32 extending generally upward from the channel 30 and a lip 34 extending generally perpendicular to the channel wall 32 may also be formed. In addition, a plurality of fixed rollers 36 may be rotatably positioned within the support system 22 to aid in the movement of the drawers relative to the support system 22. The fixed rollers 36 may be located inboard of the rollers 64 disposed on the respective drawers 52. The number and configuration of these fixed rollers 36 may be determined by the size of the support system, refrigerator, and/or number of drawers used therewith.

As shown in an embodiment of the invention of FIG. 8, the support system 22 includes a first channel 90, a second channel 92 spaced from the first channel 90, a third channel 94 spaced from the second channel 92, and a fourth channel 96 spaced from the third channel 94. The first and fourth channels 90, 96 are positioned generally on the outer edges of the support system 22 and coincide with the upstanding walls of the refrigerator compartment 14. The placements of the second and third channels 92, 94 are configured such that different sizes of drawers may be positioned between the channels. For example, between the first channel 90 and the second channel 92 may be positioned a larger drawer 26, as is shown in the figures above. As the second and third channels 92, 94 are generally closer to one another, a smaller drawer 28 would be positioned therebetween. Finally, the spacing of the third and fourth channels 94, 96 would indicate the use of a large drawer 26 therein. Thus, the support system 22 shown in FIG. 8 is configured to support a crisper system 20, including two large drawers surrounding a smaller drawer. Thus, the crisper system would include a total of three crisper drawers having two different sizes to hold perishable items therein. However, the invention contemplates that any number and size of drawers be used with the crisper and support systems of the invention. The drawers will be able to be moved relative the support system 22 and the channels 30 to open and close the drawers, as well as to remove the drawers if wanted. The drawers can be easily removed and replaced due to the configuration of the rollers and channels.

The foregoing description has been presented for purposes of illustration and description, and is not intended to be an exhaustive list or to limit the invention to precise forms disclosed. It is contemplated that other alternative processes obvious to those skilled in the art are considered to be included in the invention. The description is merely examples of embodiments. For example, the shape and size of the drawers and thus, channels may be varied according to the type of refrigerator and desires for a consumer. The number in position of the rollers on the drawers may also be configured to provide easy movement in and out of the refrigerator. It is understood that any other modifications, substitutions, and/or additions may be made that are within the intended spirit and scope of the invention. From the foregoing, it can be seen that the present invention accomplishes at least all of the stated objectives.

What is claimed is:

1. A drawer system for a home appliance comprising:
- a drawer compartment;
- a drawer comprising a pair of drawer rollers, a front wall, a back wall, a bottom wall, and opposing side walls;
- a shelf disposed above the drawer and defining a top portion of the drawer compartment;
- a support system located below the drawer comprising:
  - a front portion, a bottom portion, and opposing parallel side portions, the front portion comprising an angular upward portion;
  - wherein each of the side portions further comprise a channel defined by a substantially vertical wall extending from the bottom portion of the support system and terminating at a substantially horizontal lip;
  - wherein the front portion of the support system comprises a pair of rollers disposed inboard the drawer rollers.

2. The drawer system of claim 1, wherein the support system is formed integrally with the drawer compartment.

3. The drawer system of claim 2, wherein the support system is formed as a bottom wall of the drawer compartment.

4. The drawer system of claim 1 further comprising a first channel at a first side of the support system, a second channel positioned from the first channel, a third channel positioned from the second channel, and a fourth channel positioned from the third channel at a second side of the support system.

5. The drawer system of claim 4 further comprising a first drawer positioned between the first and second channels, a second drawer positioned between the second and third channels, and a third drawer positioned between the third and fourth channels.

6. The drawer system of claim 5, wherein the first, second, and third drawers each comprise rollers extending therefrom for moving within the channels.

7. The drawer system of claim 1, wherein the front, back, and sidewalls extend from the bottom wall.

8. The drawer system of claim 7, wherein the front wall includes a handle configured to aid in the movement of the rollers of the drawer within the channels.

9. The drawer system of claim 1, wherein the channels comprises a lock at the front of the support system to removably hold the drawer in the support system.

10. A modular drawer system for a refrigerator, comprising:

a refrigerator compartment comprising a support formed as part of a bottom wall of said compartment, the support comprising a plurality of channels and at least one support roller;

at least one drawer positioned at the support and including a plurality of drawer rollers extending outwardly and downwardly from a portion of the at least one drawer and including a stopper that generally extends downward from the at least one drawer;

wherein the plurality of drawer rollers of the at least one drawer are disposed outboard the at least one support roller and configured to be placed in at least one of the plurality of channels of a support system to aid in the movement of the drawer relative to the refrigerator compartment; and wherein the plurality of channels include a lock comprising an indent and a single vertical portion of at least one of the plurality of channels at the front of the support to removably hold the at least one drawer in the support system by blocking the stopper at the indent until a user applies an additional lifting force to fully remove the drawer from the support.

11. The modular drawer system of claim 10 further comprising a shelf positioned within the refrigerator compartment and defining a lid of the at least one drawer.

12. The modular drawer system of claim 10, wherein at least one of the plurality of channels comprise a substantially vertical wall and a lip substantially perpendicular to the substantially vertical wall.

13. The modular drawer system of claim 10, wherein the support includes a plurality of support rollers.

14. The modular drawer system of claim 13, wherein the plurality of drawer rollers are each outboard the plurality of support rollers.

15. The refrigerator of claim 10, wherein a sloped angled piece with the highest point at a front side of the support and sloping to about the height of a lip of the plurality of channels.

16. The refrigerator of claim 10, wherein the at least one support roller is mounted on one or more axles with the one or more axles being moveable in a vertical manner to move the at least one support roller into the support.

17. A refrigerator comprising: a compartment with an interior;

a drawer within the compartment and comprising a plurality of rollers rotatably disposed on a bottom portion of the drawer and the drawer comprising a stopper that generally extends downward from at least one drawer;

a drawer support system comprising:

a plurality of rails each defining at least one channel;

a sloped angled piece with the highest point at a front side of the drawer support system and sloping to about the height of a lip of the at least one channel;

a front rail with at least one roller rotatably disposed on the front rail to support the drawer; wherein the at least one roller is disposed inboard of the plurality of rollers on the drawer; and wherein the at least one channel include a lock comprising an indent and a single vertical portion of the at least one channel at a front of the drawer support to removably hold the drawer in the drawer support system by blocking the stopper at the indent until a user applies an additional lifting force to fully remove the drawer from the support.

18. The refrigerator of claim 17 further comprising a shelf defining an upper bound of the drawer.

19. The refrigerator of claim 17 further comprising a first drawer and a second drawer wherein at least one of the plurality of rails comprises two channels for supporting at least one of the plurality of rollers of each of the first and second drawers.

20. The refrigerator of claim 17, wherein the at least one channel comprises a lock along the length of the at least one channel to selectively maintain at least one of the plurality of rollers in the at least one channel.

* * * * *